US005318426A

United States Patent [19]

Hanson et al.

[11] Patent Number: 5,318,426

[45] Date of Patent: Jun. 7, 1994

[54] BRICK IMPRINTING APPARATUS

[75] Inventors: David W. Hanson, Golden Valley; Richard C. Nash, New Prague; Lloyd Barthel; James Barthel, both of Elk River; Michael Lynch, Wyoming, all of Minn.

[73] Assignee: Fabcon, Inc., Savage, Minn.

[21] Appl. No.: 37,909

[22] Filed: Mar. 26, 1993

[51] Int. Cl.[5] ..... B28B 1/29; B28B 3/02

[52] U.S. Cl. ..... 425/64; 425/150; 425/168; 425/385; 425/375; 425/457; 249/16

[58] Field of Search ..... 425/62, 63, 168, 453, 425/457, 385, 150, 375; 249/16

[56] References Cited

U.S. PATENT DOCUMENTS

| | | | |
|---|---|---|---|
| 2,857,858 | 10/1958 | Guggenheim et al. | 425/457 |
| 3,775,529 | 11/1973 | Steenson et al. | 425/385 |
| 3,910,711 | 10/1975 | Moorhead | 425/385 |
| 4,041,669 | 8/1977 | Rauenhorst | 52/576 |
| 4,141,946 | 2/1979 | Rauenhorst | 264/69 |
| 4,168,140 | 9/1979 | Fontana et al. | 425/457 |
| 4,360,333 | 11/1982 | Fox et al. | 425/299 |
| 4,369,153 | 1/1983 | Nash et al. | 264/62 |
| 4,457,682 | 7/1984 | Nash et al. | 425/219 |
| 4,628,653 | 12/1986 | Nash | 52/309.12 |
| 4,743,140 | 5/1988 | Malectic | 425/385 |
| 4,828,426 | 5/1989 | Hendricks et al. | 425/458 |

FOREIGN PATENT DOCUMENTS

| | | |
|---|---|---|
| 2482644 | 11/1981 | France . |
| 1539179 | 1/1979 | United Kingdom . |

*Primary Examiner*—Khanh Nguyen

*Attorney, Agent, or Firm*—Vidas, Arrett & Steinkraus

[57] ABSTRACT

A device for forming panels of cast concrete having simulated mortar lines. The device rests above a casting bed on the beds rails. As the bed moves relative to the device, the movement is translated to a shuttle and press mechanism that descends into the uncured concrete, makes the impression, lifts and returns to the start. At this time the rear mortar line is now in position with the device to make a new forward line due to the indexing of the bed movement relative to the device.

7 Claims, 4 Drawing Sheets

BRICK IMPRINTING APPARATUS

BACKGROUND OF THE INVENTION

1. Field of the Invention

This invention relates to an apparatus for forming hollow-core concrete slabs with a brick, block, stone or other embossed imprint on a surface.

2. Description of the Related Art

U.S. Pat. No. 4,369,153 which issued Jan. 18, 1983 to Nash et al discloses a machine which casts hollow core concrete panels in a single casting operation utilizing a slip form technique to fill cores with core material which can be dumped from the core after curing of the concrete has been accomplished. U.S. Pat. No. 4,369,153 is incorporated herein by reference.

In single casting operations, hollow core concrete panels are formed on a moving bed in which concrete is first poured around the front end of a slip form which forms the bottom layer of the concrete panel. The bed moving past the slip form shapes the bottom layer of the concrete panel. As the concrete travels on the bed past the slip form, core material which may be an aggregate, is fed into openings in the slip form to fill the desired cores with core material.

Such casting uses relatively wet concrete and often involves beds of 600 feet or more in length. A variety of patterns may be placed into the still wet concrete before it has cured. Many hand laid patterns may be made with the involvement of skilled laborers. However, such hand-operated techniques are difficult to control, since one mistake may ruin a long length of finished plank.

A number of surface finishes have been formed in which longitudinal ribbing is placed into the screed surface. This is relatively easy to accomplish as typified by U.S. Pat. No. 4,457,682. Alternatively, the top concrete may be carefully washed to expose the underlying aggregate rock. See U.S. Pat. No. 4,360,333.

Other means for making a simulated brick wall involve the placement of thin bricks into the still wet concrete. British patent 1,539,179 is an example.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

SUMMARY OF THE INVENTION

The invention provides an apparatus that may be mounted on a moving casting bed rails that will allow brick imprinting into the uncured concrete surface wherever desired. It includes a frame carried on the bed's rails by wheels. The rotation of the front traction wheels as the bed moves is used to transfer power to a registration assembly that in turn causes a shuttle carried on the frame to move forward, back, up and down. The indexing to the bed allows a press assembly of the shuttle to accurately descend into a groove left from a previous pass, such that simulated brick-work is created.

The registration assembly includes a driven chain with registration pawls that cause the shuttle to move relative to the rest of the apparatus and to encounter various sensors that will actuate cylinders for lift and descent of the press.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
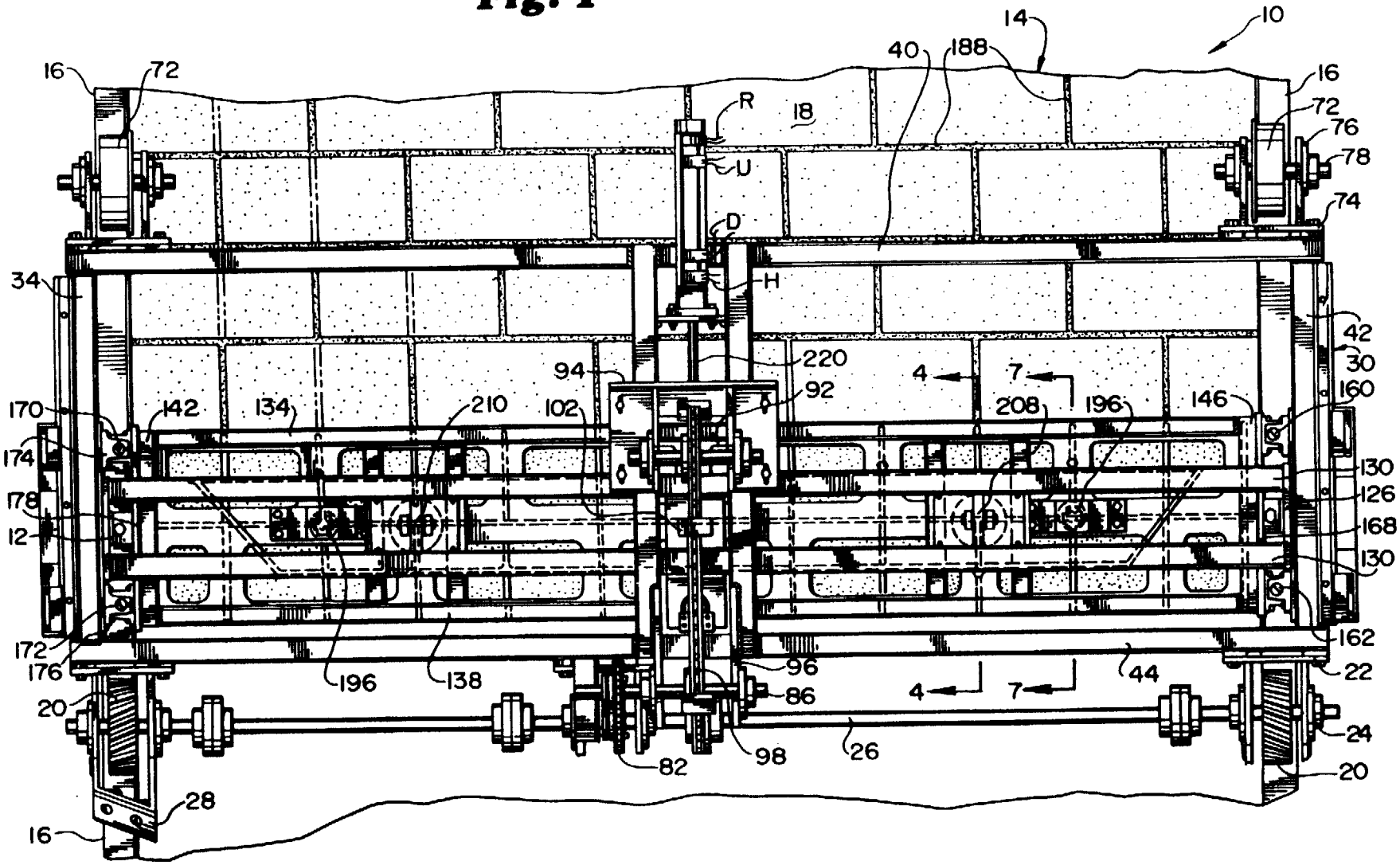
FIG. 1 is a fragmentary top plan view of the invention.
Figures 2, 3, 8:
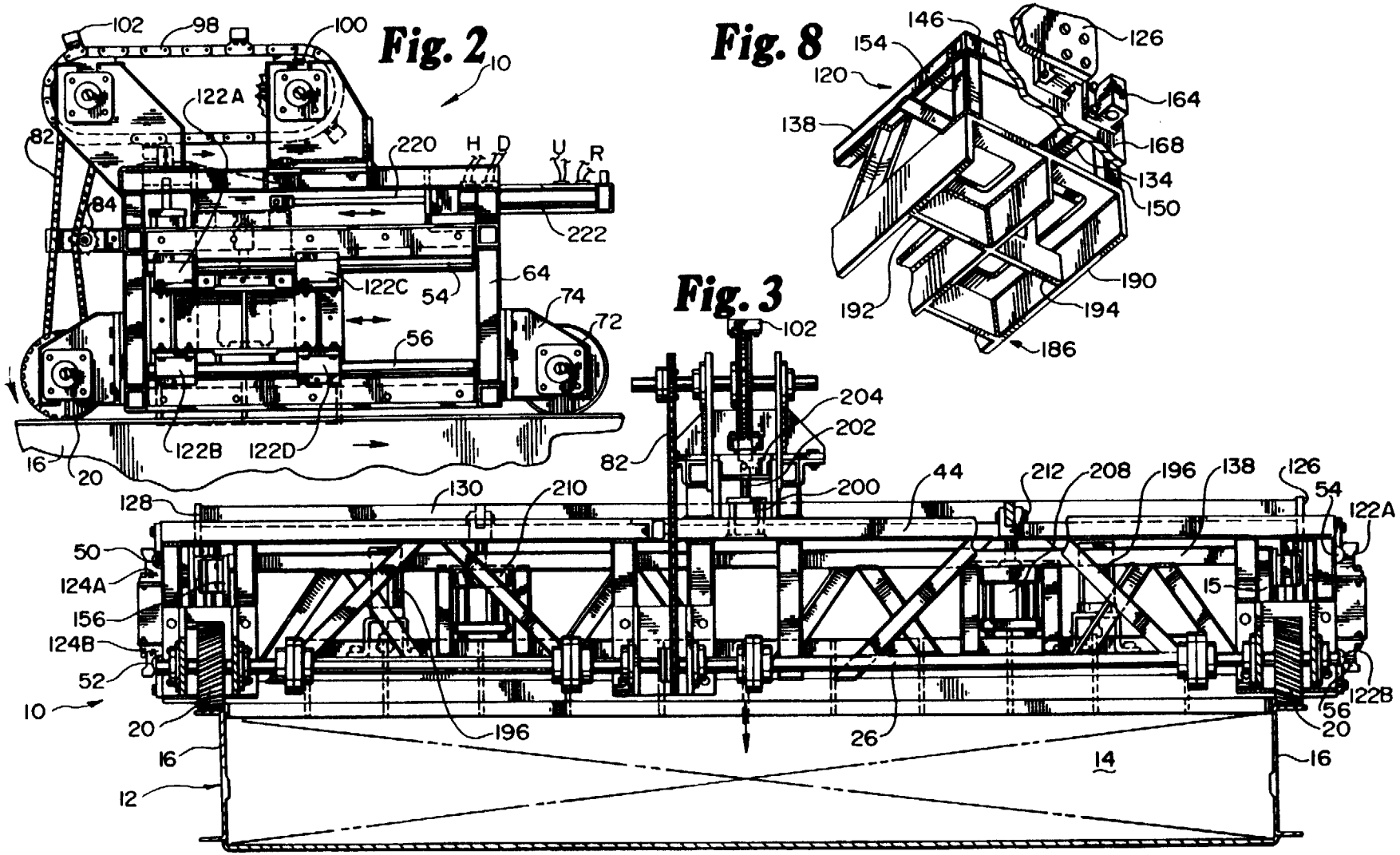
FIG. 2 is a right side elevational view thereof.
FIG. 3 is a rear elevational view thereof.
FIG. 8 is a fragmentary perspective detail of one end of the press assembly.

FIGS. 1 and 3 show the brick imprinter 10 of the invention positioned above a casting bed 12 which forms a concrete panel 14 between its side rails or channels 16. The top surface 18 of the concrete panel 14 receives the brick patterning while uncured.

The apparatus 10 includes two traction wheels 20 mounted to a wheel mount 22. The wheels 20 include wheel bearings 24 and are connected to a drive axle 26. The wheel mounts 22 are connected to the carraige frame 30. The carriage frame 30 is box-like and is formed from left upper and lower longitudinal frame members 32, 34; right upper and lower longitudinal frame members 36, 38; forward upper and lower members 40, 42 and rear upper and lower members 44, 46. These members are joined to form a rigid frame 30 via rear left and right upstanding frames 58, 60 and forward left and right upstanding frames 62, 64. That frame 30 includes left upper and lower horizontal track bars 50, 52 and right upper and lower horizontal track bars 54, 56. The front of the frame is carried on rail 16 by trolley wheels 72 attached to the frame via wheel mounts 74. The wheels 72 include wheel bearings 76 and axles 78.

The carriage frame 30 rests on rails 16 of the bed. The drawings show a casting bed in which the entire bed is driven longitudinally in the direction of the arrow 80 shown in FIGS. 2, 4, 5, 6 and 7. If the bed is stationary, the traction wheel would simply need to be driven by a motor.

The traction wheels 20 are shown with grooves to squeeze out sand and concrete that may be on the rail. In addition, a dressing blade 28 may be positioned as shown in FIG. 1 to scrape the rails clean immediately in front of the wheels.

As the bed 12 moves, the frame 30 remains fixed above the same spot. However, movement of the bed 12 causes the traction wheels 20 to rotate which causes an endless chain drive 82 to rotate. That chain drive includes a tensioner assembly 84 and causes rotation of a transfer shaft 86.

Rotation of the transfer shaft 86 is used as an indexing or registration of the imprinter which matches the speed of the moving bed 12. The transfer shaft 86 includes a drive sprocket 88 which is part of the registration assembly 90. That assembly 90 includes an idler axle 92 rotatably mounted to an idler bracket 94 which is itself mounted to frame 30. Transfer shaft 86 is rotatably mounted to registration drive bracket 96 attached to frame 30. Assembly 90 further includes a chain 98 between idler sprocket 100 and drive sprocket 88. Chain 98 includes spaced registration pawls 102, the purpose of which will be discussed later.

Carriage frame 30 is built to guide a shuttle 120 held to the frame by right linear bearings 122*a,b,c,d* to horizontal track bars 54, 56 and to left linear bearings 124*a,b,c,d* to horizontal track bars 50, 52. The linear bearings 122, 124 are attached to right and left header plates 126, 128. The header plates are connected by transverse headers 130 as best shown in FIG. 1.

The shuttle 120 is basically a rectangular box formed by forward upper and lower members 134, 136; rear upper and lower members 138, 140; left upper and lower members 142, 144; right upper and lower members 146, 148 and interconnecting uprights 150, 152, 154 and 156. As shown in FIG. 1, the right side of shuttle 120 is slidably held to header plate 126 by right forward and rear vertical track bars 160, 162 and bearing blocks 164, 166 which are attached to a right end plate 168 as shown in FIG. 8. The left side of shuttle 120 is slidably held to header plate 128 by left forward and rear vertical track bars 170, 172 and bearing blocks 174, 176 which are attached to a right end plate 178 as shown in FIG. 8.

With such an arrangement, the shuttle is able to move up and down along the vertical track bars and horizontally by the interconnection with the horizontal track bars relative to the carriage frame 30. The shuttle 120 includes a lower press 186 which when lowered into the uncured concrete forms the mortar lines 188 of the simulated brick. It includes longitudinal impression members 190 and transverse impression members 192 as best shown in FIG. 8. The transverse impression members 192 are staggered to create the usual staggered mortar line look of brickwork. In the event that a different pattern is desired, an auxiliary transverse impression member 194 may be lowered down by an auxiliary cylinder 196.

The movement of the shuttle 120 is indexed from the movement of the traction wheels 20. As wheel 20 rotates, the movement is carried via chain 82 to chain 98. That chain 98 includes multiple registration pawls 102 that engage with control mechanisms for moving the shuttle up, down, forward and backward.

The shuttle 120 includes a strike cylinder 200 whose ram 202 raises and lowers a strike block 204 and a strike 206. When the ram is fully extended by the cylinder 200, the strike 206 is caught by a registration pawl 102 as shown in FIGS. 1, 4, 5, 6 and 7. As chain 98 rotates, the pawl 102 against strike 206 moves the shuttle in the direction of arrow 80, relative to carriage frame 30. The pawl moves the shuttle forward at exactly the same pace of the concrete panel relative to the carriage frame, ensuring proper indexing.

Figure 4:
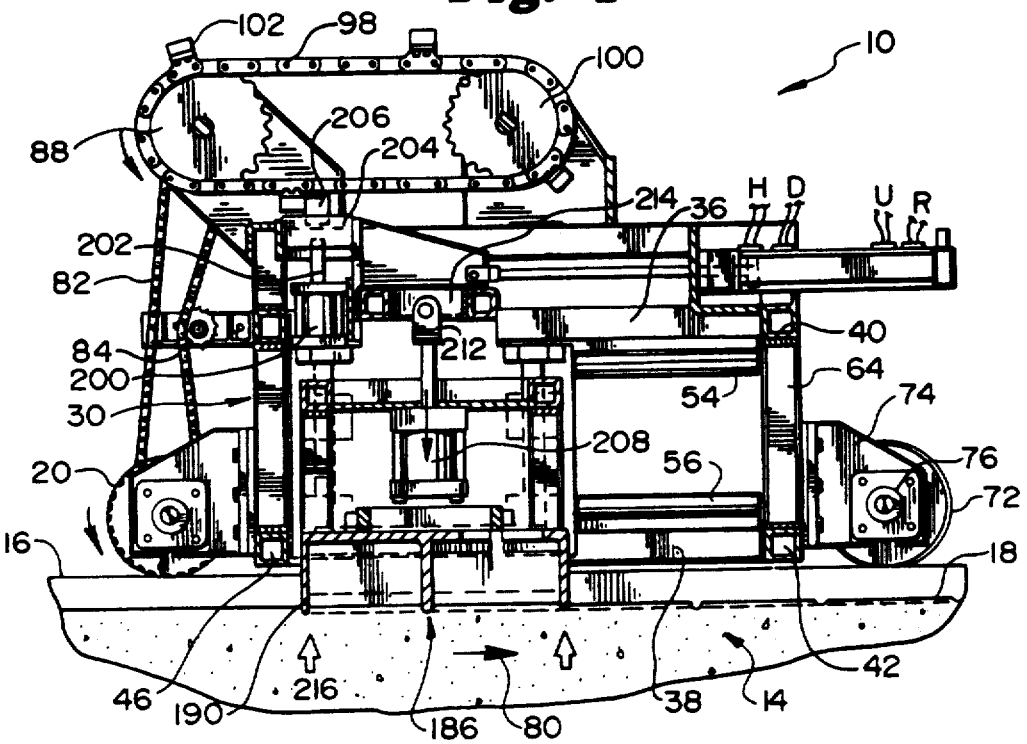
FIG. 4 is a sectional elevation taken along line 4—4 in FIG. 1.
Figure 5:
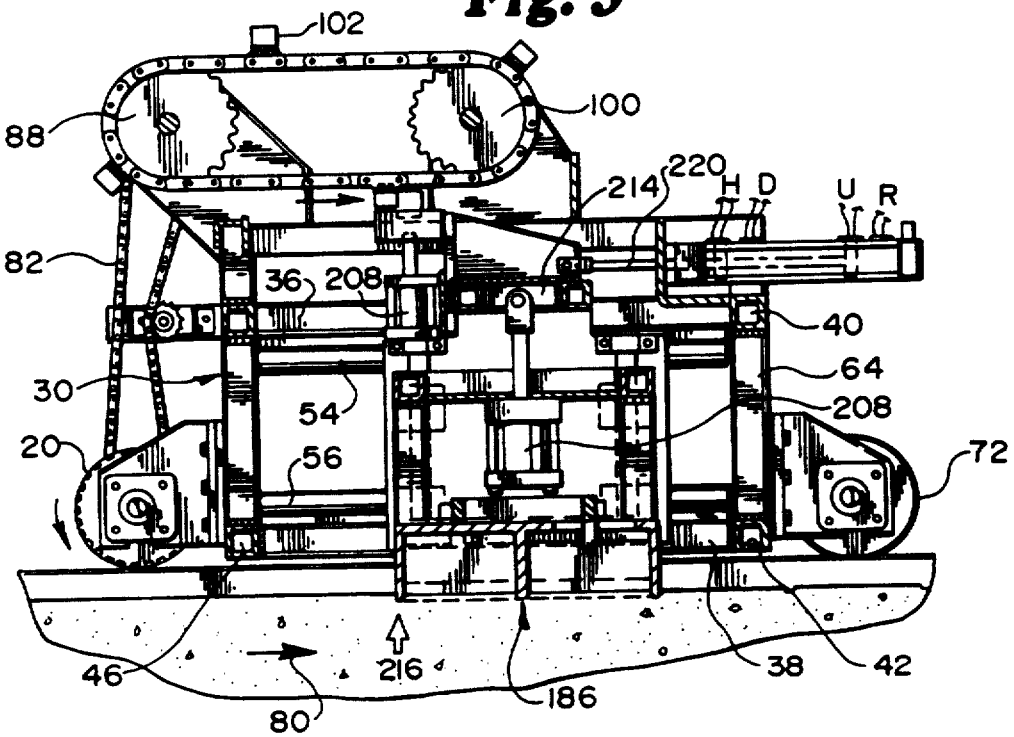
FIG. 5 is a sectional elevation similar to that of FIG. 4 thereof shown advanced.
Figure 6:
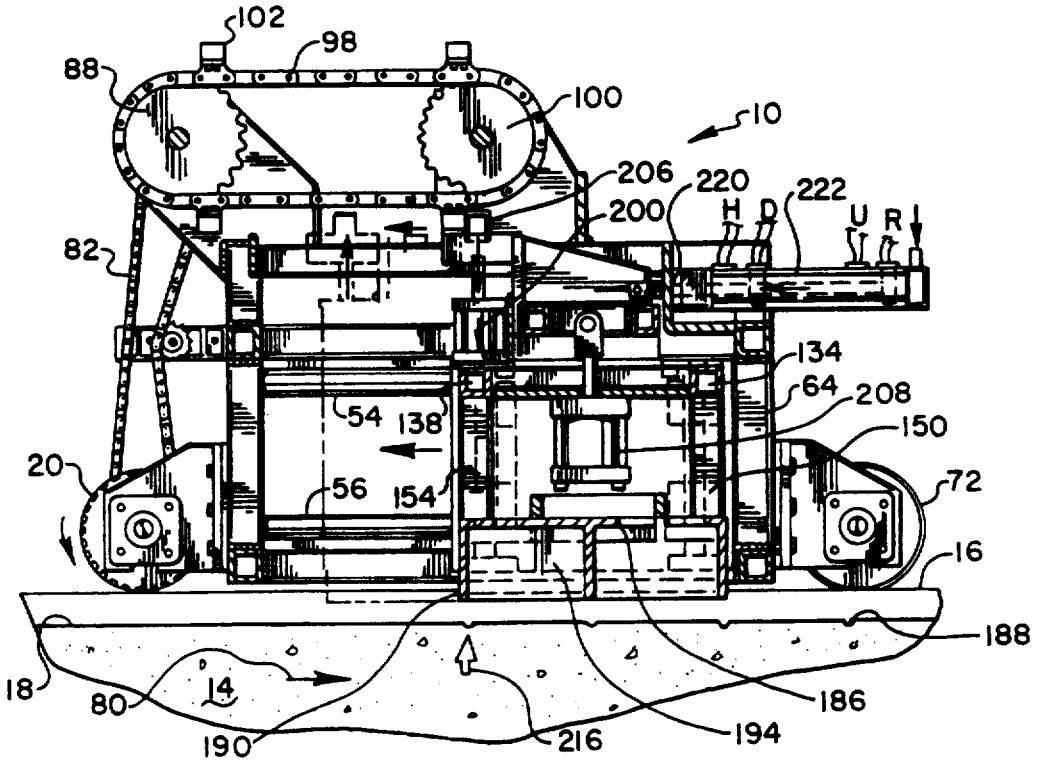
FIG. 6 is a sectional elevation similar to that of FIGS. 4 and 5 thereof shown retracted and returning to reset position.
Figure 7:
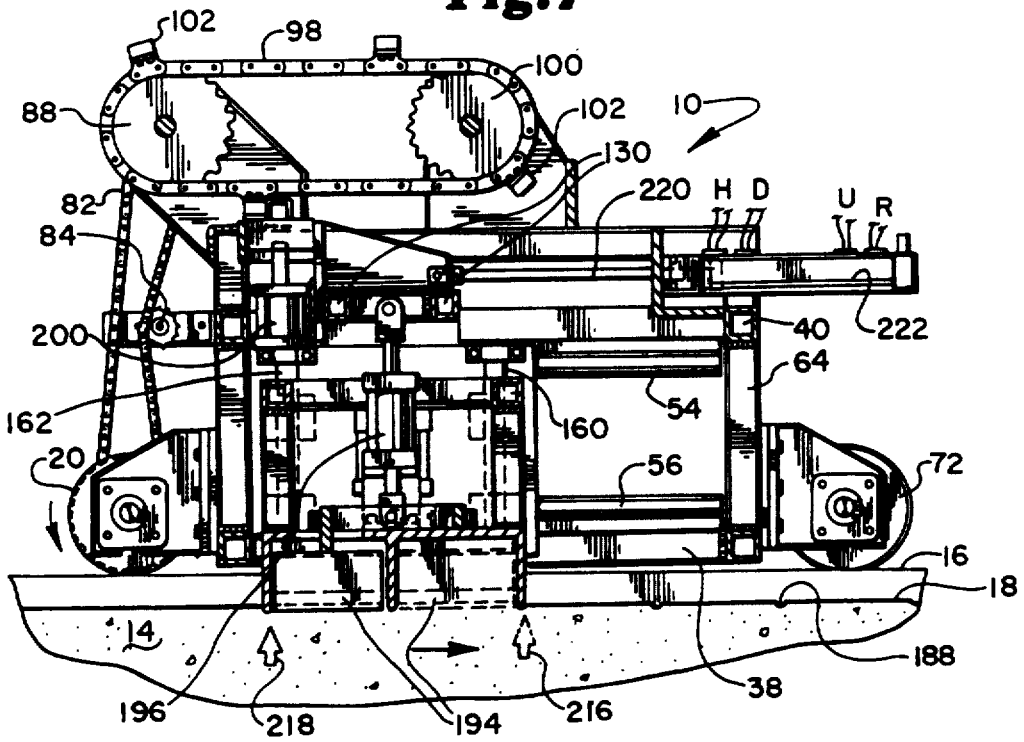
FIG. 7 is a sectional elevation taken along line 7—7 in FIG. 1.

A pair of lift cylinders 208, 210 connected by a clevis 212 to a cross support 214 of the headers 130 operate to depress the press 186 into the uncured concrete. The lift cylinders shown herein are pneumatic, but may be hydraulic or other mechanism that imparts lift. FIG. 4 shows the press 186 imprinting a pattern into the concrete immediately after the lift cylinders 208, 210 are depressed. FIG. 5 shows the same apparatus later in time as the concrete bed moves relative to the carriage. Note first reference marker 216 compared to new reference marker 218. As the shuttle 120 moves relative to the carriage, a shuttle piston 220 moves into shuttle cylinder 222. As it reaches a "U" or "up" sensor, a signal is made to a controller that actuates lift cylinders 208, 210 causing them to lift the press 186 from the concrete. The mechanism is easily controlled by a simple controller or a programmable controller.

As the shuttle piston 220 is further depressed into shuttle cylinder 222, a second sensor "R" for "return" is activated, causing a signal from a controller to actuate strike cylinder 200 causing the strike to lower and disengage from the pawl 102. The raised press 186 is then pushed back via shuttle piston 220 toward the start position shown in FIG. 7, which causes sensor "D" for "down" to send a signal to the controller directing the lift cylinder 208 to push the press 186 down into the concrete. It will be seen that the forward portion of press 186 is originally at reference marker 216, and after one cycle, the forward portion is now at new reference marker 218, exactly the position where the rear-most portion of the press 186 had been positioned.

Mortar lines 188 are made over and over as the press is depressed into the old trailing mortar line and forms a new trailing line. The indexing of the movement of the press relative to the speed the bed moves relatively allows precise control of the mortar lines. The machine continues to cycle until told otherwise, creating simulated brick with sharp, matched joints due to the precise control.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. It is noted that reference to "brick" herein is for ease of writing, and that "brick imprinting" includes any pattern imprinting, including brick, block, stone or other embossed patterns.

This completes the description of the preferred and alternate embodiments of the invention. Those skilled in the art may recognize other equivalents to the specific embodiment described herein which equivalents are intended to be encompassed by the claims attached hereto.

What is claimed is:

1. In a machine for casting concrete panels on a casting pallet including a floor and a pair of parallel side walls, concrete being cast in the space between the floor and side walls, the improvement comprising brick imprinting means for providing simulated mortar lines on the top surface of said concrete panel, said brick imprinting means comprising:

(a) a carriage frame supported above said casting pallet on wheels rotatably in contact with said pair of parallel side walls;

(b) a press means including a brick form and a shuttle suspended from said carriage frame, said press means being constructed and arranged to descend to imprint into said concrete, raise from said concrete and move along the longitudinal axis of said casting pallet; and (c) indexing means for controlling movement of said press means, said indexing means being constructed and arranged to move said press means in direct proportion to movement of said carriage frame relative to said casting pallet, said indexing means including means for moving said shuttle and brick form down against the concrete, horizontally relative to the carriage frame, up off of said concrete, and back horizontally to an original position before lowering down into said concrete.

2. The machine of claim 1 wherein said indexing means is coupled to at least one of said wheels such that rotation of said wheels causes said press means to move at the same rate of movement of said carriage frame relative to said casting pallet.

3. The machine of claim 2 wherein said brick form is suspended from said frame by longitudinal and vertical guide bars and said brick form is raised and lowered relative to said casting pallet by pneumatic lifts and is moved longitudinally relative to said casting pallet by said indexing means and at least one pneumatic lift.

4. The machine of claim 1 further including pneumatic lift means and a supplemental brick pattern which is moved with or without said brick form.

5. The machine of claim 2 wherein said indexing means includes an endless chain drive driven by rotation of said wheels, said chain drive including a plurality of registration pawls to engage with and cause said brick form to move.

6. In a machine for casting concrete panels on a casting pallet including a floor and a pair of parallel side walls, concrete being cast in the space between the floor and side walls, the improvement comprising brick imprinting means for providing simulated mortar lines on the top surface of said concrete panel, said brick imprinting means comprising:

(a) a carriage frame supported above said casting pallet on wheels rotatably in contact with said pair of parallel side walls;

(b) a shuttle, including a brick form, suspended from said carriage frame, said shuttle including suspension means connected to said carriage frame for supporting said shuttle to allow vertical and horizontal movement of said shuttle and brick form relative to said carriage frame; and (c) indexing means for controlling movement of said shuttle, said indexing means being constructed and arranged to move said press means in direct proportion to movement of said carriage frame relative to said casting pallet, said indexing means including means for moving said shuttle and brick form down against the concrete, horizontally relative to the carriage frame, up off of said concrete, and back horizontally to an original position before lowering down into said concrete.

7. The machine of claim 6 further including pneumatic lift means and a supplemental brick pattern which is moved with or without said brick form.

* * * * *